US006488150B1

(12) United States Patent
Gordon et al.

(10) Patent No.: US 6,488,150 B1
(45) Date of Patent: Dec. 3, 2002

(54) BULK PACKAGING SYSTEM AND METHOD

(75) Inventors: David L. Gordon, Lancaster; Paul R. Pelfrey, Wheelersburg, both of OH (US)

(73) Assignee: Crane Plastics Siding LLC, Columbus, OH (US)

( * ) Notice: Subject to any disclaimer, the term of this patent is extended or adjusted under 35 U.S.C. 154(b) by 71 days.

(21) Appl. No.: 09/717,988

(22) Filed: Nov. 21, 2000

(51) Int. Cl.[7] ..... B65D 85/20; B65D 27/10

(52) U.S. Cl. ..... 206/321; 53/399; 53/444; 100/2; 206/442; 206/443; 410/41

(58) Field of Search ..... 53/399, 444, 176, 53/139.6, 139.7; 100/2; 206/321, 442, 443; 217/66; 410/36, 37, 41, 99, 155

(56) References Cited

U.S. PATENT DOCUMENTS

| | | | | | |
|---|---|---|---|---|---|
| 2,248,119 | A | * | 7/1941 | Reed et al. | 100/2 |
| 2,730,259 | A | * | 1/1956 | Frick | 206/443 |
| 3,220,583 | A | * | 11/1965 | Robertson | 100/2 |
| 3,288,311 | A | * | 11/1966 | Beattie | 206/443 |
| 3,307,691 | A | * | 3/1967 | Vallebona | 410/41 |
| 4,092,815 | A | * | 6/1978 | Rowley et al. | 53/399 |
| 4,799,350 | A | * | 1/1989 | Rias | 53/399 |
| 4,830,184 | A | * | 5/1989 | Legler | 206/442 |
| 4,969,307 | A | * | 11/1990 | Winans et al. | 53/399 |
| 5,878,548 | A | * | 3/1999 | Sauer et al. | 410/41 |
| 5,884,456 | A | | 3/1999 | Hansen | |
| 5,943,846 | A | | 8/1999 | Pollock | |
| 6,050,761 | A | * | 4/2000 | Keip et al. | 410/41 |
| 6,152,663 | A | * | 11/2000 | Keip et al. | 410/41 |
| 6,182,837 | B1 | * | 2/2001 | Crabtree | 206/443 |
| 6,264,410 | B1 | * | 7/2001 | Kelp et al. | 410/41 |
| 6,270,299 | B1 | * | 8/2001 | Rehbein | 410/41 |

FOREIGN PATENT DOCUMENTS

| | | | | |
|---|---|---|---|---|
| GB | 812641 A | * | 4/1959 | 100/2 |
| GB | 2101954 | * | 1/1983 | |

* cited by examiner

*Primary Examiner*—Stephen F. Gerrity
(74) *Attorney, Agent, or Firm*—Standley & Gilchrist LLP

(57) ABSTRACT

A method and system for bundling elongated material surrounded with a plurality of binding frames, each binding frame having vertical and horizontal members attached so as to form a rectangular shaped frame. The vertical and horizontal members are connected using corner jigs, each corner jig having a horizontal base adapted to receive a horizontal member and a vertical sleeve adapted to receive a vertical member. Each binding frame is then surrounded with a binding band adapted to hold the corner jigs and frames in place so as to maintain the elongated material in the bundle.

20 Claims, 6 Drawing Sheets

BULK PACKAGING SYSTEM AND METHOD

BACKGROUND AND SUMMARY OF THE INVENTION

The present invention relates generally to methods of packing material bundles and the like. Specifically, this invention relates to a method and system for bundling elongated materials utilizing reusable frames.

Securely bundling heavy elongated materials such as vinyl siding or lumber has traditionally been a difficult and cumbersome task. The extreme weight of such bundles typically requires a great amount of lumber and associated labor in order to construct a framework of sufficient strength to hold the material in place. Oftentimes these lumber frames collapse due to the weight of the material or the inability of the bundles to withstand stacking.

It is therefore an object of the present invention to develop a stronger and more cost-effective system and method for bundling elongated material.

The present invention includes a bulk packaging system for bundling elongated material. The system utilizes binding frames that are adapted to surround the elongated material. Each binding frame has two vertical and two horizontal members, preferably elongated rectangular members, with each member having opposing ends. Each end of a vertical member is in contact with an end of a horizontal member so as to form a rectangular shape to the frame.

Corner jigs are used to reinforce the binding frames. Each corner jig has a horizontal base having an inner channel and a groove. The inner channel of the base is adapted to engage a horizontal member of a binding frame. The groove is of appropriate size and shape to receive a binding band. The corner jig also has a vertical sleeve attached to the horizontal base so as to form an angle. The vertical sleeve has an opening opposite the horizontal base and a groove along the sleeve. The opening is adapted to receive a vertical member of a binding frame, and the groove is of an appropriate size and shape to receive a binding band. Each frame has a corner jig to connect each vertical member to each horizontal member. Each frame also has a binding band surrounding the corner jigs and the frame such that each frame bundles the elongated material.

Also included in the present invention is a method for packaging elongated material in a bundle. First, the elongated material is surrounded with a plurality of binding frames, each binding frame having vertical and horizontal members connected so as to form a rectangular shaped frame. The vertical and horizontal members are connected using corner jigs, each corner jig having a horizontal base adapted to receive a horizontal member and a vertical sleeve adapted to receive a vertical member. Each binding frame is then surrounded with a binding band adapted to hold the corner jigs and frames in place so as to maintain the elongated material in the bundle.

In addition to the novel features and advantages mentioned above, other objects and advantages of the present invention will be readily apparent from the following descriptions of the drawings and preferred embodiments.

BRIEF DESCRIPTION OF THE DRAWINGS

Novel features and advantages of the present invention, in addition to those mentioned above, will become apparent to those skilled in the art from a reading of the following detailed description in conjunction with the accompanying drawings.

DETAILED DESCRIPTION OF PREFERRED EMBODIMENT(S)

In accordance with the foregoing summary of the invention, the following presents a detailed description of the present invention presented against the backdrop of bulk material packaging in accordance with the present invention. The detailed description of the present invention presented is presently considered to be the best mode thereof.

Figure 1:
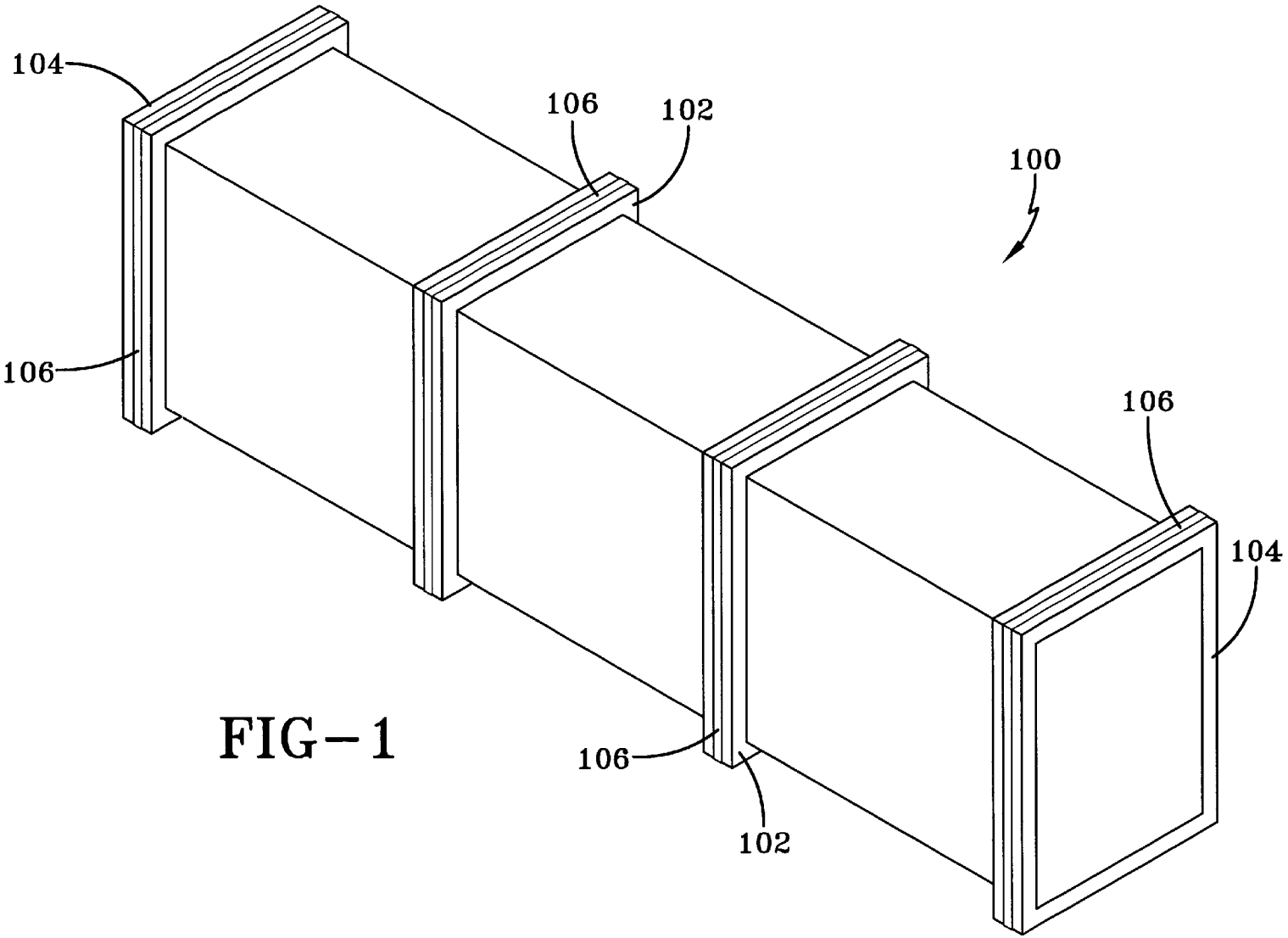
FIG. 1 is a perspective view of a bundle of elongated material secured with four binding frames in accordance with one embodiment of the present invention.

FIG. 1 shows a perspective view of a bundle 100 of elongated material secured with four binding frames: two interior frames 102, and two exterior frames 104. The frames may be of any appropriate material, but are preferably made primarily of wood. After the binding frames are assembled, steel bands 106 are wrapped around their periphery to further secure them. It is preferred that four binding frames are positioned equidistant along the length of the bundle, with the outer frames 104 positioned at opposite ends of the bundle 100. The framed bundles 100 may then be easily manipulated with a forklift or other similar device.

Figure 2:
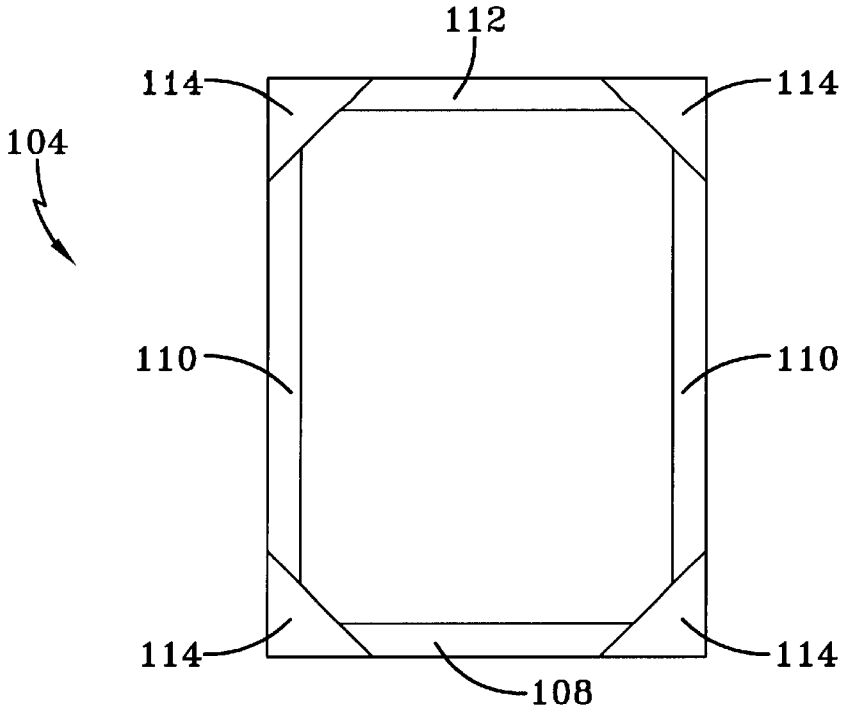
FIG. 2 is a front view of a binding frame with wood gussets on the corners in accordance with one embodiment of the present invention.

FIG. 2 shows an outer binding frame 104 of the present invention. Typically, the material to be bundled is loaded onto the bottom horizontal member 108 of each binding frame. The vertical side members 110 and top horizontal member 112 are positioned around the periphery of the bundle and nailed together, thus enclosing the bundle.

These framed bundles are often stacked on top of each other, which may lead to problems due to the weight of the bundle and instability of the non-reinforced frames. The end result is the collapse or distortion of the bundles, which may impose time delays and the further expense of frame repair. One way to solve this problem is to nail a gusset 114 to each corner of the outer binding frames 104, leaving the inner binding frames without any such reinforcement. Although this solution does somewhat strengthen the overall framed bundle, the frames are oftentimes still unable to prevent bundle collapse. Reinforcing the corners with gussets also imposes additional fabrication cost and time delay.

Figure 3:
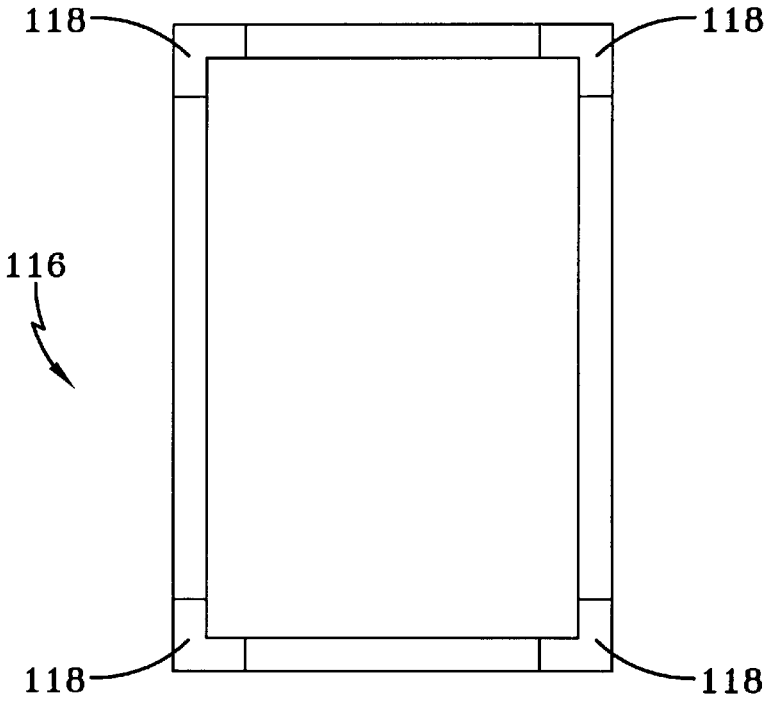
FIG. 3 is a front view of a binding frame with corner jigs on all four corners in accordance with one embodiment of the present invention.

As shown in FIG. 3, a preferred solution is to reinforce every corner of each binding frame 116, as opposed to only the outermost ones, with a corner jig 118. These corner jigs 118 are preferably made of steel, but it should be appreciated that other materials of appropriate strength and rigidity, such as wood or plastic, may be used without compromise.

Figure 4:
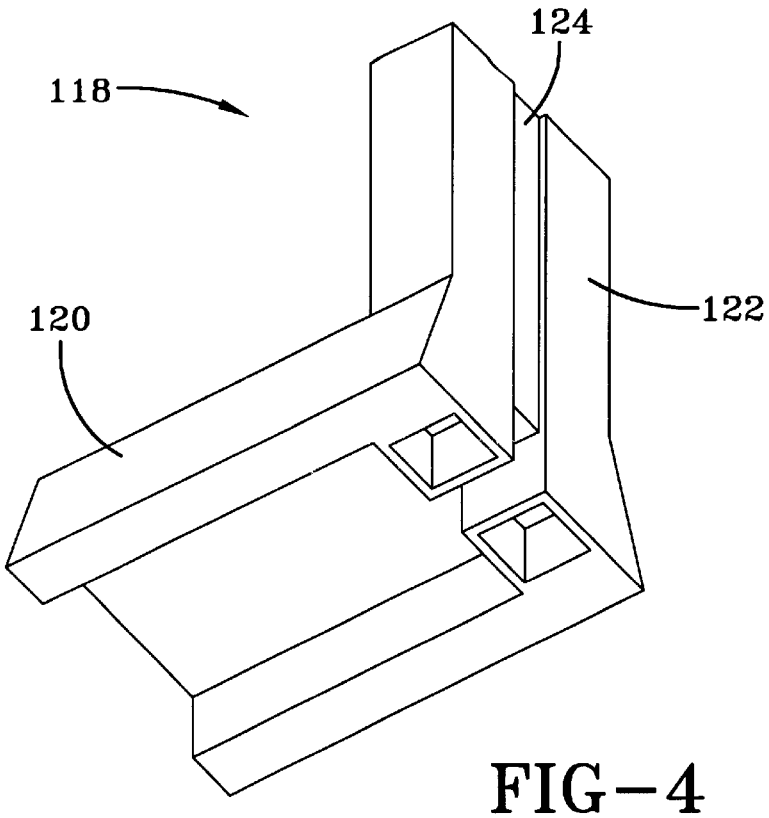
FIG. 4 is a perspective view of a corner jig in accordance with one embodiment of the present invention.
Figure 5:
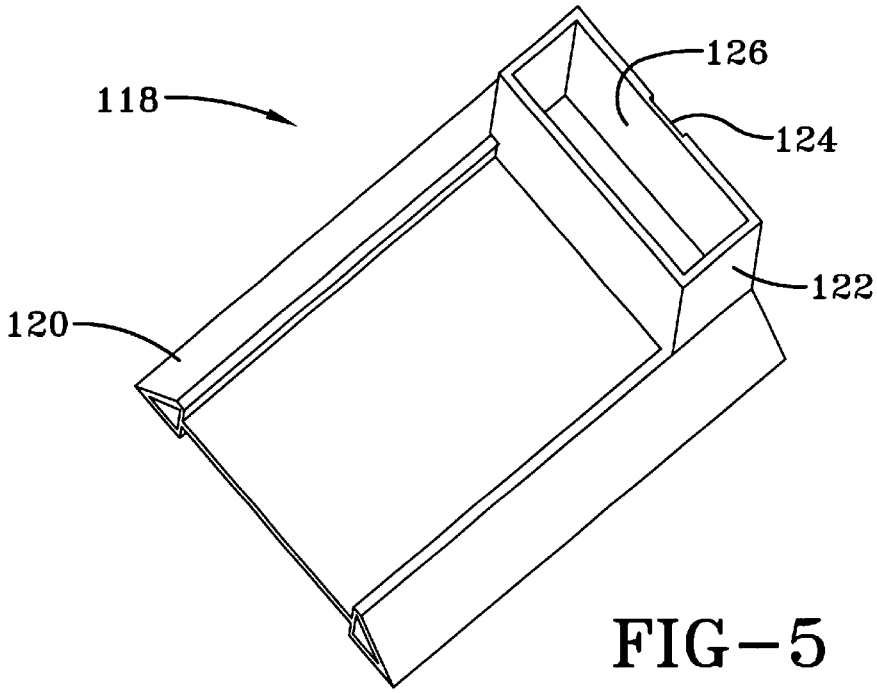
FIG. 5 is another perspective view of a corner jig in accordance with one embodiment of the present invention.

FIGS. 4 and 5 show perspective views of a preferred corner jig 118 of the present invention. The corner jig 118 has a horizontal base 120 and a vertical sleeve 122. The outer surface of the horizontal base 120 and outer surface of the vertical sleeve 122 are adapted to have a groove 124 into which may be inserted a steel band or other appropriate binding material. When the corner jig 118 is in place, the steel band is applied in the groove 124 of each jig in order to further secure the binding frame assembly.

The vertical sleeve 122 has inner and outer surfaces, with an opening 126 in the end of the sleeve opposite the horizontal base. The opening 126 preferably has a rectangular cross section and faces away from the horizontal base 120 so as to allow for insertion of one of the vertical frame members. The vertical sleeve 124 and horizontal base 122 are preferably permanently affixed to one another so as to form a substantially right angle.

Figure 6:
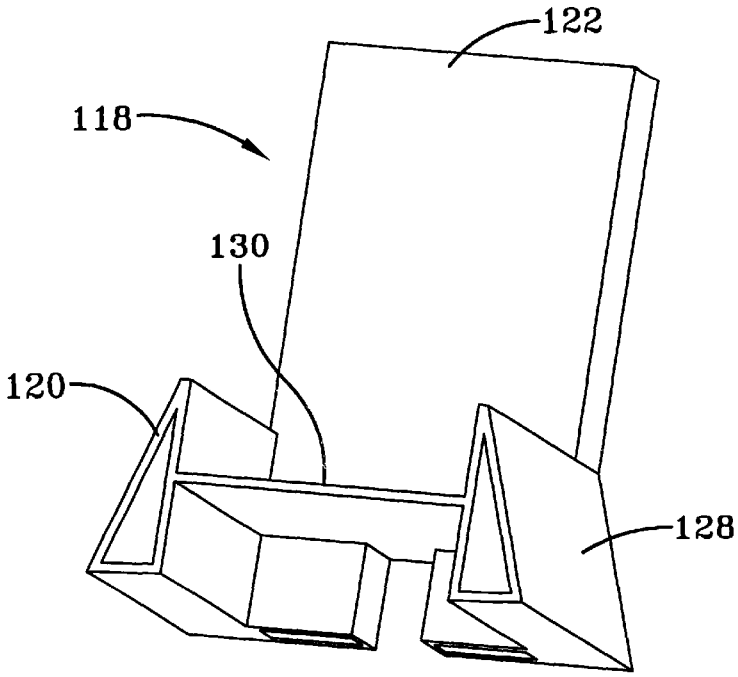
FIG. 6 is another perspective view of a corner jig in accordance with one embodiment of the present invention.
Figure 7:
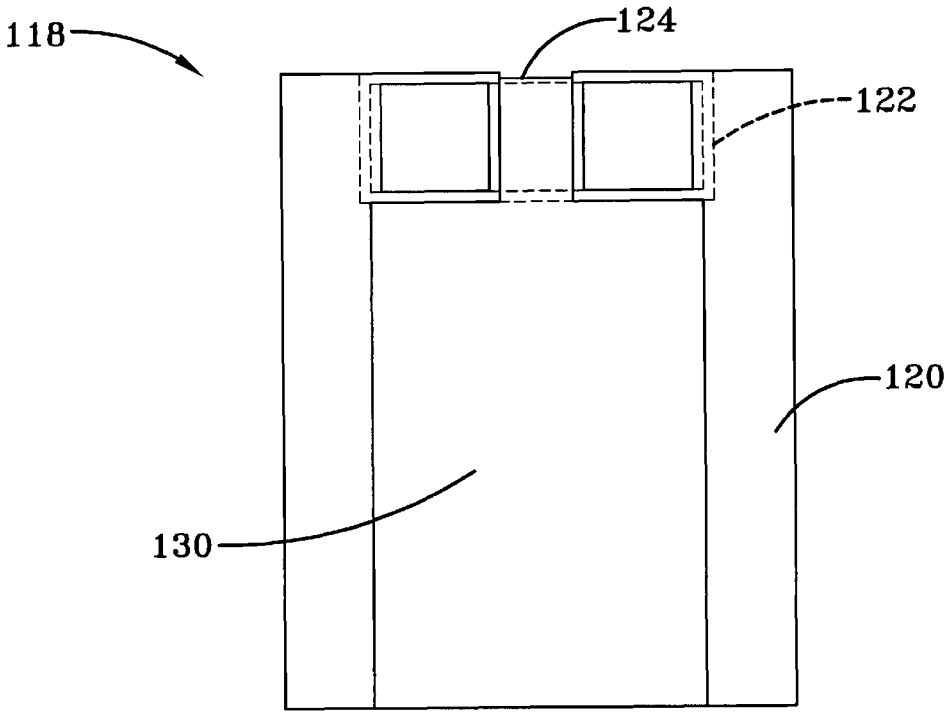
FIG. 7 is a bottom view of a corner jig in accordance with one embodiment of the present invention.

Referring now to FIGS. 6 and 7, the horizontal base 120 has longitudinal sides 128. The longitudinal sides 128 are outwardly beveled, preferably at an angle of about 30 degrees, so as to cause each side 128 to be wider at the end opposite the vertical sleeve 122. It should be appreciated that this angle may be varied appropriately. The horizontal base 120 is adapted to have a horizontal channel 130, the horizontal channel 130 preferably having a rectangular cross section. The channel should be of appropriate size and shape so as to allow the insertion of a piece of stock material to be bundled. The piece of stock material preferably fits inside the channel 130 and abuts the inner surface of the vertical sleeve 122.

Figure 8:
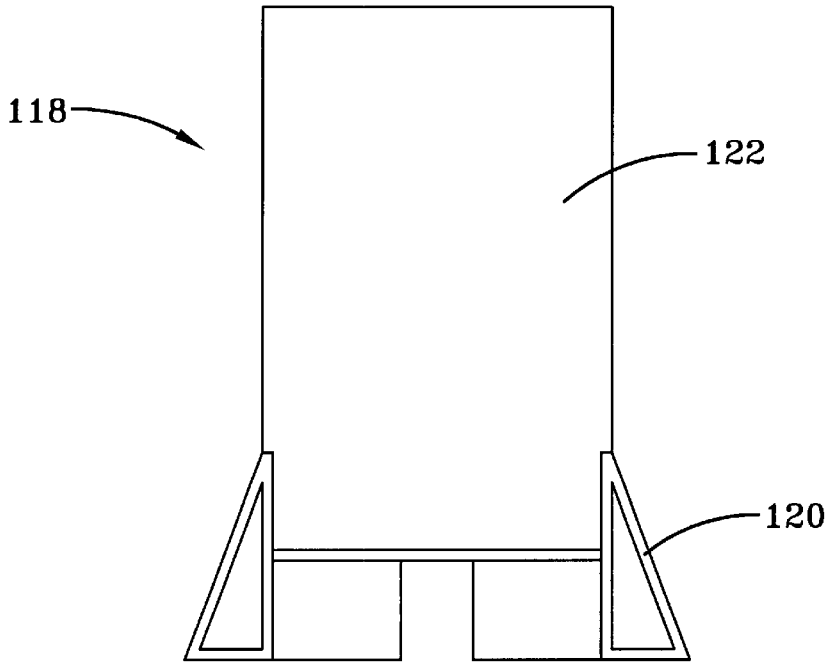
FIG. 8 is a front view of a corner jig in accordance with one embodiment of the present invention.
Figure 9:
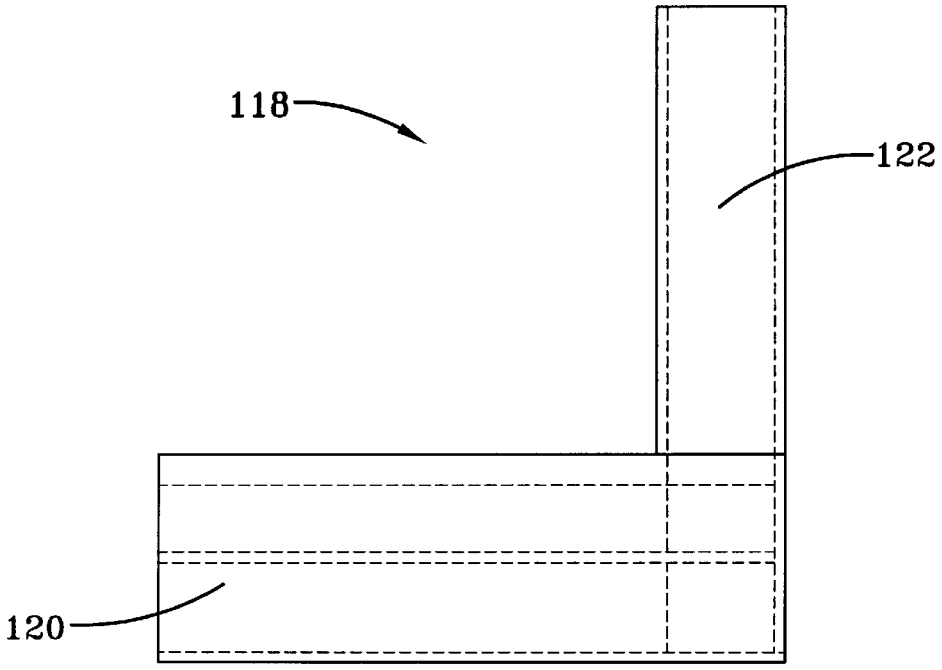
FIG. 9 is a side view of a corner jig in accordance with one embodiment of the present invention.

In a preferred embodiment, the horizontal channel 130 consists of a flat sheet of stock attached to the base 120 and vertical sleeve 122. When viewed from the front, as depicted in FIG. 8, the cross-sectional view of the horizontal base 120 has the appearance of a flat shelf attached to the adjacent sides of two right-triangles, the opposite sides facing downwards, and the hypotenuse facing outward and forming the beveled sides. It is appreciated that different methods of adapting the horizontal base 120 to have an horizontal channel along its length may be used without compromising the spirit and scope of the present invention. For instance, the horizontal base 120 could be formed by machining an initially solid rectangular block of stock to have outwardly beveled sides and a horizontal channel. In this embodiment, the frontal cross-sectional view would have the appearance of a notched isosceles trapezoid.

Referring back to FIG. 3, the vertical and horizontal members of the binding frames 116 are slidably engaged to the corner jigs 118 without nails or other similar fastening means. Once in place, the steel bands are applied to secure and tighten the binding frame to the bundle of elongated material. Having the corner jigs slidably engaged to the members of the binding frames without nails or other similar fastening means is advantageous because of the reduction in time that is required to assemble the binding frames.

Figure 10:
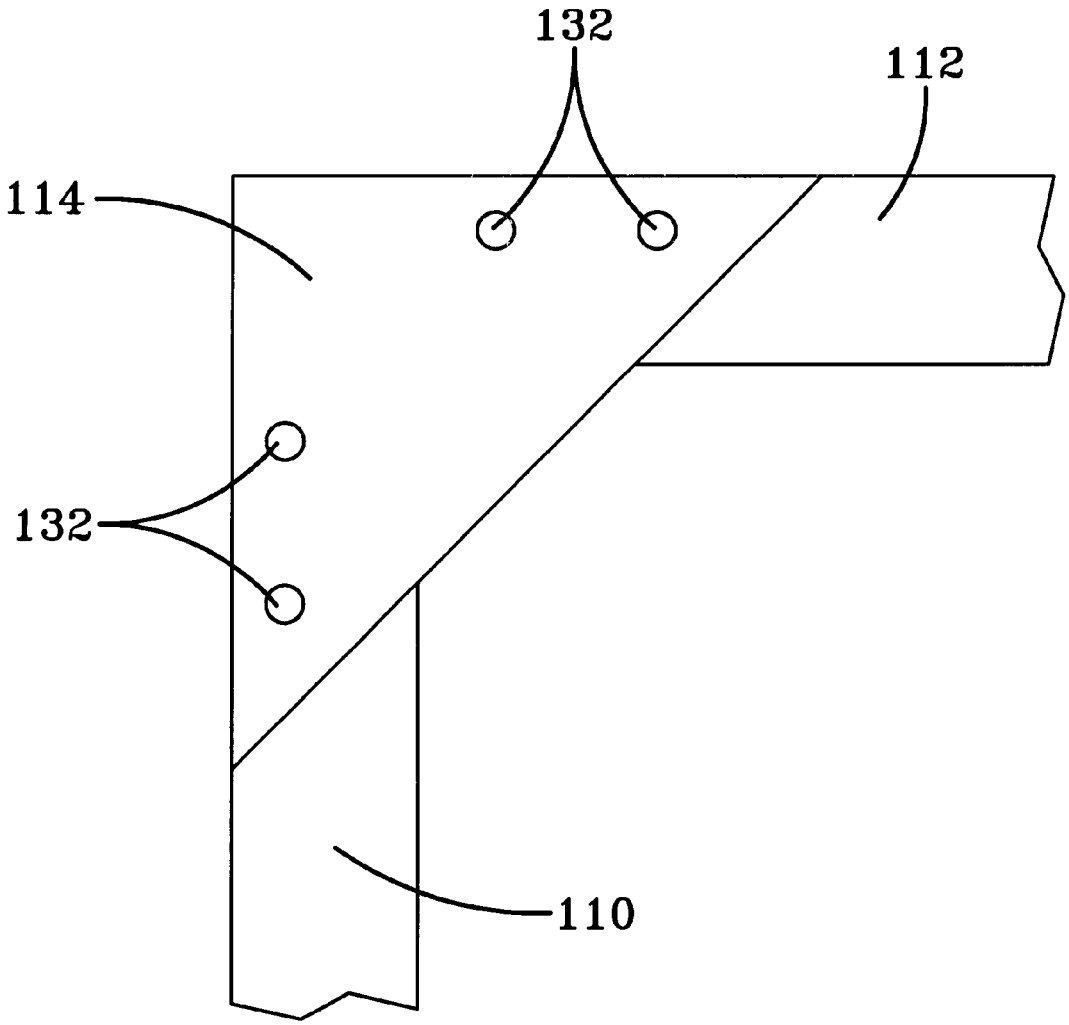
FIG. 10 is an exploded view of a corner of a binding frame reinforced by a gusset in accordance with one embodiment of the present invention.

As depicted in FIG. 10, attaching wood gussets 114 with nails 132 to the horizontal member 112 and vertical member 110 at each corner of the outermost binding frames is much more time consuming. The strength and durability of the corner jigs, as well as the absence of fastening means, allows the corner jigs to be reused, resulting in substantial cost savings. Furthermore, the added strength of a preferred frame means that thinner pieces of lumber may be used for the horizontal and vertical members. Using thinner pieces of lumber, with no loss in overall strength, results in significant material cost savings.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A bulk packaging system for bundling elongated material, said system comprising:

(a) a plurality of binding frames adapted to surround said elongated material, each of said binding frames having two vertical and two horizontal members, wherein each said vertical and horizontal member has opposing ends and each end of a vertical member is in contact with an end of a horizontal member so as to form a rectangular shape to said frame;

(b) a plurality of binding bands, each said binding band adapted to surround a said binding frame and maintain said binding frame in contact with said elongated material; and (c) a plurality of corner jigs for reinforcing said binding frames, each of said corner jigs comprising:

(1) a horizontal base, said horizontal base having an inner channel and a groove, wherein said inner channel is adapted to engage a said horizontal member of a said binding frame and wherein said groove is adapted to receive a said binding band; and (2) a vertical sleeve, said vertical sleeve attached to said horizontal base so as to form an angle, said vertical sleeve having an opening opposite said horizontal base and a groove along said vertical sleeve, said opening adapted to receive a said vertical member of a said binding frame, said groove adapted to receive a said binding band;

whereby each said frame has a plurality of said corner jigs adapted to connect each said vertical member to each said horizontal member and a said binding band surrounding said corner jigs and said frame such that each frame bundles said elongated material.

2. A bulk packaging system according to claim 1 wherein said vertical members and said horizontal members comprise elongated rectangular members.

3. A bulk packaging system according to claim 1 wherein said vertical members and said horizontal members comprise members composed of materials selected from the group consisting of wood, plastic, and steel.

4. A bulk packaging system according to claim 1 wherein each said bundle of elongated material comprises four binding frames.

5. A bulk packaging system according to claim 1 wherein said binding frames are positioned equidistant along said elongated material.

6. A bulk packaging system according to claim 1 wherein said binding bands are steel bands.

7. A bulk packaging system according to claim 1 wherein said corner jigs are composed of materials selected from the group consisting of wood, plastic, and steel.

8. A bulk packaging system according to claim 1 wherein said vertical sleeve and said horizontal base of each said corner jig join to form a right angle.

9. A bulk packaging system according to claim 1 wherein said horizontal base of a said corner jig has longitudinal sides that are at an angle with respect to said vertical sleeve.

10. A bulk packaging system according to claim 9 wherein said longitudinal sides of said jig are at an angle of approximately 30 degrees with respect to said vertical sleeve.

11. A bulk packaging system according to claim 1 wherein a said inner channel of a said horizontal base of a said corner jig comprises a flat sheet of stock attached to said horizontal base.

12. A method for packaging elongated material in a bundle, said method comprising the steps of:

(a) surrounding said elongated material with a plurality of binding frames, each said binding frame having vertical and horizontal members attached so as to form a rectangular shaped said binding frame;

(b) connecting said vertical members to said horizontal members using corner jigs, each said corner jig having a horizontal base adapted to receive a said horizontal member and a vertical sleeve adapted to receive a said vertical member; and (c) surrounding each said binding frame with a binding band, said binding band adapted to hold said corner jigs and said frames in place so as to maintain said elongated material in said bundle.

13. A method according to claim 12 wherein said vertical members and said horizontal members comprise elongated rectangular members.

14. A method according to claim 12 wherein said vertical members and said horizontal members comprise members composed of materials selected from the group consisting of wood, plastic, and steel.

15. A method according to claim 12 wherein each said bundle of elongated material comprises four binding frames.

16. A method according to claim 12 wherein said binding frames are positioned equidistant along said elongated material.

17. A method according to claim 12 wherein said binding bands are steel bands.

18. A method according to claim 12 wherein said corner jigs are composed of materials selected from the group consisting of wood, plastic, and steel.

19. A method according to claim 12 wherein said horizontal base of a said corner jig has longitudinal sides that are at an angle with respect to said vertical sleeve.

20. A method according to claim 19, wherein said longitudinal sides of said jig are at an angle of approximately 30 degrees with respect to said vertical sleeve.

* * * * *

UNITED STATES PATENT AND TRADEMARK OFFICE

CERTIFICATE OF CORRECTION

PATENT NO. : 6,488,150 B1 
DATED : December 3, 2002
INVENTOR(S) : Gordon et al.

It is certified that error appears in the above-identified patent and that said Letters Patent is hereby corrected as shown below:

Title page,
Item [57], ABSTRACT,
Please delete:

"A method and system for bundling elongated material surrounded with a plurality of binding frames, each binding frame having vertical and horizontal members attached so as to form a rectangular shaped frame. The vertical and horizontal members are connected using corner jigs, each corner jig having a horizontal base adapted to receive a horizontal member and a vertical sleeve adapted to receive a vertical member. Each binding frame is then surrounded with a binding band adapted to hold the corner jigs and frames in place so as to maintain the elongated material in the bundle." and insert:

-- The present invention relates generally to methods of packing material bundles and the like. Specifically, this invention relates to a method and system for bundling elongated materials utilizing reusable frames.

In the invention, elongated material is surrounded with a plurality of binding frames, each binding frame having vertical and horizontal members attached so as to form a rectangular shaped frame. The vertical and horizontal members are connected using corner jigs, each corner jig having a horizontal base adapted to receive a horizontal member and a vertical sleeve adapted to receive a vertical member. Each binding frame is then surrounded with a binding band adapted to hold the corner jigs and frames in place so as to maintain the elongated material in the bundle. --.

Signed and Sealed this

Twenty-fifth Day of March, 2003

JAMES E. ROGAN
*Director of the United States Patent and Trademark Office*